US005480137A

United States Patent [19]

Haupenthal

[11] Patent Number: 5,480,137

[45] Date of Patent: Jan. 2, 1996

[54] SUCTION-AIR CONTROL DEVICE FOR A SHEET-TRANSFER DRUM

[75] Inventor: Rudi Haupenthal, Epfenbach, Germany

[73] Assignee: Heidelberger Druckmaschinen AG, Heidelberg, Germany

[21] Appl. No.: 240,921

[22] Filed: May 10, 1994

[30] Foreign Application Priority Data

May 10, 1993 [DE] Germany ..... 43 15 549.9

[51] Int. Cl.[6] ..... B65H 5/14

[52] U.S. Cl. ..... 271/276; 271/108; 137/624.15

[58] Field of Search ..... 271/94, 96, 108, 271/270, 276; 137/624.15

[56] References Cited

U.S. PATENT DOCUMENTS

| | | | |
|---|---|---|---|
| 1,921,380 | 8/1933 | Barker, Jr. | 137/624.15 |
| 2,841,391 | 7/1958 | Norton | 271/96 X |
| 3,069,025 | 12/1962 | Winkler et al. | 271/96 X |
| 3,916,790 | 11/1975 | Alix | 271/96 X |
| 4,162,066 | 7/1979 | McCain et al. | 271/96 X |

FOREIGN PATENT DOCUMENTS

| | | | |
|---|---|---|---|
| 3842390 | 6/1990 | Germany . | |
| 64935 | 3/1989 | Japan | 271/108 |

*Primary Examiner*—H. Grant Skaggs
*Attorney, Agent, or Firm*—Herbert L. Lerner; Laurence A. Greenberg

[57] ABSTRACT

A suction-air control device for a rotatable sheet-transfer drum having suction-type grippers disposed thereon and having a journal with a rotationally symmetrical surface, includes a rotary valve disposed on the journal of the sheet-transfer drum for connecting the suction-type grippers to a stationary suction-air source. A stationary housing is provided for the rotary valve. A device controls a supply of suction air from the suction-air source to the suction-type grippers with a time lead or a time lag as a function of the rotational speed of the sheet-transfer drum. At least one suction-air bore extends from the interior of the journal to the surface thereof. One suction-air bore is connectable to the suction-type grippers. The rotationally symmetrical surface of the journal forms a sealing surface of the rotary valve. At least one closing member formed with at least one air-passage opening disposed over a defined rotational-angle range connects the one suction-air bore formed in the journal with at least one connection hole formed in the housing of the rotary valve.

8 Claims, 1 Drawing Sheet

Fig.1
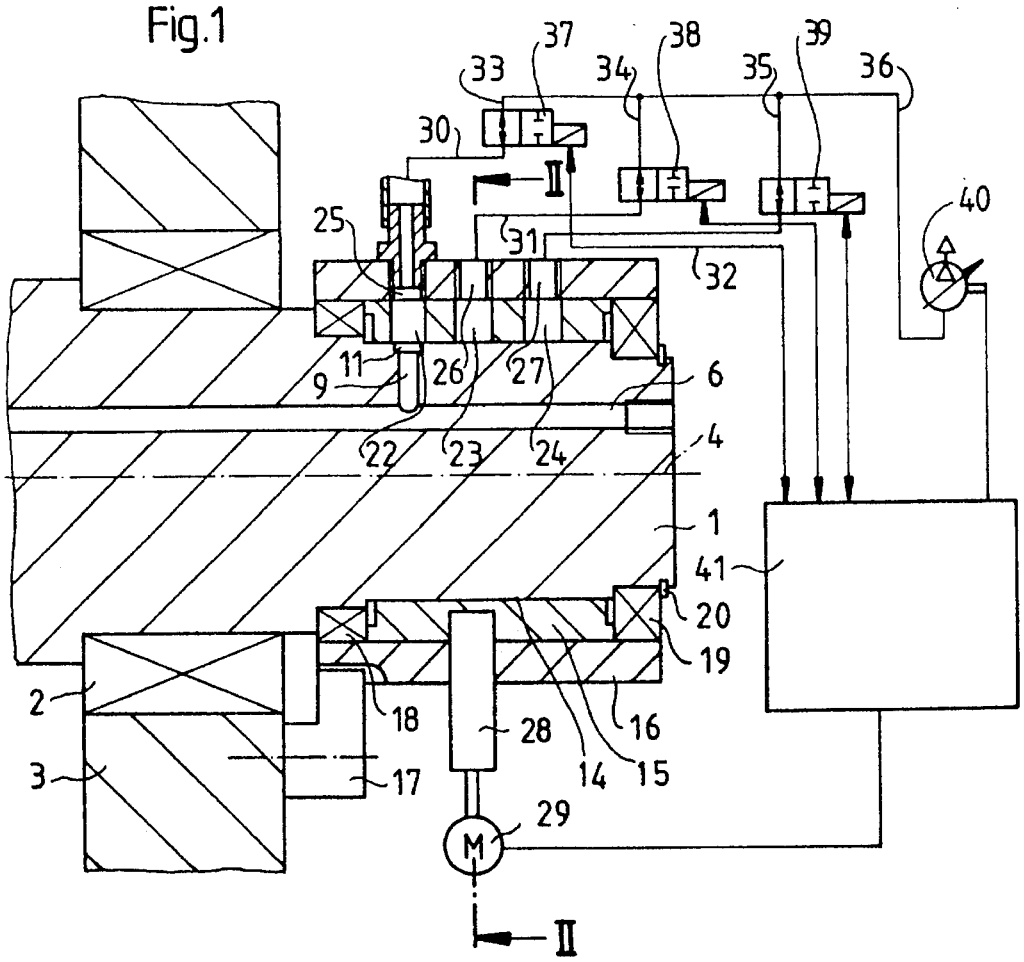
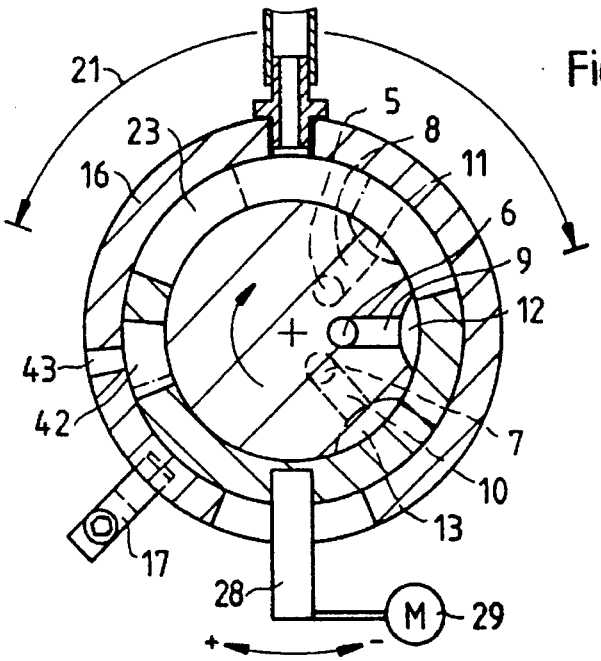
Fig.2

SUCTION-AIR CONTROL DEVICE FOR A SHEET-TRANSFER DRUM

The invention relates to a suction-air control device for a sheet-transfer drum, more particularly, of the type usable in sheet-fed rotary printing presses, which has grippers for holding sheets on the sheet-transfer drum, at least some of which are formed as suction-type grippers.

Suction air to the suction-type grippers can be supplied through a rotary valve in the sheet-transfer drum. For this purpose, one or both bearing journals of the sheet-transfer drum may be constructed so that the surface of the bearing journal or journals forms a sealing surface of the rotary valve. The suction air must be applied to the suction-type grippers in full strength over a defined rotational-angle range of the sheet-transfer drum. In order to ensure this application of suction air, it is necessary for the suction-air supply to the suction-type grippers to be controlled with a time lead and a lag time, respectively, in accordance with or as a function of the rotational speed of the sheet-transfer drum. In order to control the suction air, it has become known heretofore to employ a control device, to which signals relating to the rotational speed and the rotational angle are able to be supplied. The control device may operate an actuating element which advances the timing of the suction-air supply at very high rotational speeds with respect to a lower rotational speed. An example of such a suction-air control is described in the German Published Non-prosecuted Patent Application (DE) 38 42 390 A1 for controlling valve units of a sheet-feeder suction head.

The constructions according to the state of the prior art have the disadvantage that the actuating elements for the speed-dependent suction-air supply are disposed far away from the consuming devices, so that, due to the relatively large volume to be evacuated, control is slow, which limits the maximum possible transport speed of the sheets. This factual situation is disadvantageous likewise with regard to the venting of the suction-type grippers. When the sheets are being removed from the sheet-transfer drum, the suction-type grippers must be vented quickly, which requires a relatively long time period when the volume of air is large.

It is accordingly an object of the invention to provide a suction-air control device for a sheet-transfer drum which permits a rapid evacuation and venting of the suction-type grippers thereof.

With the foregoing and other objects in view, there is provided, in accordance with the invention, a suction-air control device for a rotatable sheet-transfer drum having suction-type grippers disposed thereon and having a journal with a rotationally symmetrical surface, comprising a rotary valve disposed on the journal of the sheet-transfer drum for connecting the suction-type grippers to a stationary suction-air source, a stationary housing for the rotary valve, and means for controlling a supply of suction air from the suction-air source to the suction-type grippers with a time lead or a time lag as a function of the rotational speed of the sheet-transfer drum, means defining at least one suction-air bore extending from the interior of the journal to the surface thereof, the one suction-air bore being connectable to the suction-type grippers, the rotationally symmetrical surface of the journal forming a sealing surface of the rotary valve, and at least one closing member formed with at least one air-passage opening disposed over a defined rotational-angle range for connecting the one suction-air bore formed in the journal with at least one connection hole formed in the housing of the rotary valve.

In accordance with another feature of the invention, a group of the suction-type grippers is associated with the one suction-air bore, the one air-passage opening and the one connection hole, and a shut-off device is included which is connected in a line between the one connection hole and the suction-air source.

In accordance with a further feature of the invention, the device includes actuating means connected to the one closing member for rotating the one closing member, the shut-off device and the actuating means being connected to the controlling means.

In accordance with an added feature of the invention, the rotatable closing member is formed with at least one vent opening, the one vent opening being associated with the one suction-air bore.

In accordance with an additional feature of the invention, the device includes a plurality of the suction-air bores extending from the interior of the journal to the surface thereof, the plurality of suction-air bores being connectable to the suction-type grippers, and a plurality of the closing members formed with a plurality of the air-passage openings disposed over the defined rotational-angle range for connecting the plurality of suction-air bores formed in the journal with a plurality of the connection holes formed in the housing of the rotary valve.

In accordance with yet another feature of the invention, respective groups of the suction-type grippers are associated with the suction-air bores, the air-passage openings and the connection holes, respectively, and respective shut-off devices are included which are connected in respective lines between the respective connection holes and the suction-air source.

In accordance with yet a further feature of the invention, the device includes actuating means connected to the closing member for rotating the closing member, the shut-off devices and the actuating means being connected to the controlling means.

In accordance with a concomitant feature of the invention, the rotatable closing member is formed with a plurality of vent openings, the vent openings, respectively, being associated with the suction-air bores.

Thus, in accordance with the invention, a rotatable closing member is provided on a journal of a sheet-transfer drum. The closing member is formed with air-passage openings over a defined rotational-angle range, the air-passage openings ensuring a connection between suction-air bores formed in the journal and connection holes formed in a housing. The suction-air bores formed in the journal are connected directly to the suction-type grippers. Furthermore, the closing member may be formed with vent openings, additionally, each of the vent openings being associated with a respective suction-air bore. If the journal is advantageously cylindrical in form, then the outer cylindrical surface of the journal and the inner surface of the sleeve-shaped closing member form a first pair of sealing surfaces. The outer cylindrical surface of the closing member and the inner cylindrical surface of the housing form a second pair of sealing surfaces. Shut-off valves may be incorporated into the connection between the connection holes, on the one hand, and a suction-air source, on the other hand.

It is advantageous if each group of suction-type grippers is associated with a respective suction-air bore formed in the journal, a respective air-passage opening formed in the closing member and a respective connection hole formed in the housing. For effecting rotation thereof, the closing member may be connected to an actuating device. The actuating device and the shut-off valves may be connected to a common control device, with the result that speed-dependent control of groups of the suction-type grippers is possible. A sheet-transfer drum may be provided with two or more rows of suction-type grippers which are controllable individually or in groups in accordance with the invention. The rotatable closing member acts as an actuating element for the suction-air control. Because the closing member on the journal is disposed close to the suction-type grippers, the volume to be evacuated or to be vented is small, so that the suction-air supply can be quickly switched on and off. For faster venting of the suction-type grippers, it is possible to apply compressed air periodically to the air ducts leading to the suction-type grippers, for which purpose a suitable air source may be provided.

Other features which are considered as characteristic for the invention are set forth in the appended claims.

Although the invention is illustrated and described herein as embodied in a suction-air control device for a sheet transfer drum, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a diagrammatic longitudinal sectional view of a bearing journal of a sheet-transfer drum wherein the suction-air device of the invention is schematically illustrated; and FIG. 2 is a cross-sectional view of FIG. 1 taken along the line II—II in the direction of the arrows.

Referring now to the figures of the drawing, there is shown therein a bearing journal 1 of a sheet-transfer drum. The bearing journal 1 is situated in a bearing 2 mounted in a side wall 3 of a printing press. Machined into the bearing journal 1, parallel to a rotational axis 4 of the sheet-transfer drum, are longitudinal bores 5, 6 and 7 and, connected thereto, transverse bores 8, 9 and 10. The longitudinal bores 5, 6 and 7, respectively, are connected to a group of suction-type grippers. The transverse bores 8, 9 and 10 terminate in countersinks 11, 12 and 13, respectively, of the outer cylindrical surface 14 of the bearing journal 1. A sleeve-shaped closing member 15 turnable about the rotational axis 4 is seated on the outer cylindrical surface 14. The outer cylindrical surface 14 and the inner cylindrical surface of the closing member 15 form sealing surfaces. The closing member 15 lies between the bearing journal 1 and a housing 16, the outer cylindrical surface of the closing member 15 and the inner cylindrical surface of the housing 16 likewise being formed as sealing surfaces. By means of a locking element 17, the housing 16 is frame-fixed in the side wall 3. Bearings 18 and 19 are mounted between the housing 16 and the bearing journal 1, the bearing 19 being secured by means of a retaining ring 20 against axial displacement on the bearing journal 1.

Over a defined rotational-angle range 21, the closing member 15 is formed with air-passage openings 22, 23 and 24 for connecting the countersinks 11, 12 and 13, respectively, with suction-air holes 25, 26 and 27, respectively, which are formed in the housing 16. For turning or rotating the closing member 15 about the rotational axis 4, the closing member 15 is connected to an entrainer or driving element 28, which is connected, in turn, to a servo-motor 29. The suction-air holes 25, 26 and 27 are connected to a suction-air source 40 through the intermediary of lines 30, 31, 32, 33, 34, 35, 36 and 2/2-way valves 37, 38 and 39. Electromagnetic actuating or operating elements for the 2/2-way valves 37, 38 and 39, the suction-air source 40 and the servo-motor 29 are connected to a common control device 41. The control device 41 is of conventional construction for converting in put signals into respective output signals. Thus, a signal regarding the sheet format or size, which may, for example, originate from automatic format setting means, when received by the control device 41, causes the latter to output a signal which activates the 2/2-way valves 37, 38 and 39 to operate the suction-type gripper group or groups. A signal regarding sheet thickness or grade, for example, permeable paper, smooth paper, and so forth, is inputted into the control device 41 and the output signal therefrom adjusts the pressure or, indeed, the negative pressure or underpressure of the suction-air source 40 so that, for example, very thin paper, should not be sucked into the suction-type grippers. Also, an input signal regarding press speed, for example, from a speed control sensor, is fed to the control device 41 and suitably processed therein to provide an output signal which actuates the servo-motor 29 to effect a turning of the closing member 15 in a clockwise direction in the event of an increase in the press speed, and in a counter-clockwise direction in the event of a decrease in the press speed, as viewed in FIG. 2.

The suction-air control 41 is described in further detail hereinbelow:

For the group of suction-type grippers which is to be supplied with suction air from the suction-air source 40, the corresponding 2/2-way valve is opened by means of the control device 41. The respective group of suction-type grippers is supplied with suction air over the rotational-angle range 21 in which the corresponding countersinks 11, 12 and 13, respectively, in the outer cylindrical surface 14 terminates in one of the air-passage openings 22, 23 and 24. When a countersink 11, 12 and 13 comes under an additional vent opening 42 provided in the closing member 15, the respective group of suction-type grippers is vented through a vent hole 43 formed in the housing 16, so that a sheet can be removed from the sheet-transfer drum.

If the control device is supplied with signals relating to the rotational speed of the sheet-transfer drum, the servo-motor 29 can be driven as a function of the rotational speed. The servo-motor 29, which is connected to the entrainer or driving element 28, causes the closing member 15 to rotate in relation to the bearing journal 1 and in relation to the housing 16, respectively. It is consequently possible to vary, as a function of speed, the timing for the application of suction air to a group of suction-type grippers and for the venting of the suction-type grippers. When a line volume and a conveying or delivery volume of the suction-air source 40 are both constant, assurance is always provided that, with increasing printing-press speed, sufficient time is available for building up the vacuum or underpressure and for venting.

I claim:

1. Suction-air control device for a rotatable sheet-transfer drum having suction-type grippers disposed thereon and having a journal with a rotationally symmetrical surface, comprising a rotary valve disposed on the journal of the sheet-transfer drum for connecting the suction-type grippers to a stationary suction-air source, a stationary housing of said rotary valve, and means for controlling a supply of suction air from the suction-air source to the suction-type grippers with a time lead or a time lag as a function of the rotational speed of the sheet-transfer drum, means defining at least one suction-air bore extending from the interior of the journal to the surface thereof, said one suction-air bore being connectable to the suction-type grippers, the rotationally symmetrical surface of the journal forming a sealing surface of the rotary valve, and said rotary valve comprising at least one closing member formed with at least one air-passage opening disposed over a defined rotational-angle range for connecting the one suction-air bore formed in the journal with at least one connection hole formed in said housing of said rotary valve, said closing member being rotatably disposed relative to said housing and relative to the journal; and wherein said controlling means include actuating means connected to said one closing member for rotating said one closing member.

2. Device according to claim 1, wherein a group of the suction-type grippers is associated with said one suction-air bore, said one air-passage opening and said one connection hole, and including a shut-off device connected in a line between said one connection hole and the suction-air source.

3. Device according to claim 2, wherein said shut-off device is connected to said controlling means.

4. Device according to claim 3, wherein said rotatable closing member is formed with at least one vent opening, said one vent opening being associated with the one suction-air bore.

5. Suction-air control device for a rotatable sheet-transfer drum having suction-type grippers disposed thereon and having a journal with a rotationally symmetrical surface, comprising a rotary valve disposed on the journal of the sheet-transfer drum for connecting the suction-type grippers to a stationary suction-air source, a stationary housing of said rotary valve, and means for controlling a supply of suction air from the suction-air source to the suction-type grippers with a time lead or a time lag as a function of the rotational speed of the sheet-transfer drum, means defining at least one suction-air bore extending from the interior of the journal to the surface thereof, said one suction-air bore being connectable to the suction-type grippers, the rotationally symmetrical surface of the journal forming a sealing surface of the rotary valve, and said rotary valve comprising at least one closing member formed with at least one air-passage opening disposed over a defined rotational-angle range for connecting the one suction-air bore formed in the journal with at least one connection hole formed in said housing of said rotary valve, said closing member being rotatably disposed relative to said housing and relative to the journal, a plurality of suction-air bores extending from the interior of the journal to the surface thereof, said plurality of suction-air bores being connectable to the suction-type grippers, and said closing member being formed with a plurality of said air-passage openings disposed over said defined rotational-angle range for connecting the plurality of suction-air bores formed in the journal with a plurality of said connection holes formed in said housing of said rotary valve.

6. Device according to claim 5, wherein respective groups of the suction-type grippers are associated with said suction-air bores, said air-passage openings and said connection holes, respectively, and including respective shut-off devices connected in respective lines between the respective connection holes and the suction-air source.

7. Device according to claim 6, wherein said controlling means include actuating means connected to said closing member for rotating said closing member, and wherein said shut-off devices are connected to said controlling means.

8. Device according to claim 7, wherein said rotatable closing member is formed with a plurality of vent openings, said vent openings, respectively, being associated with said suction-air bores.

* * * * *